United States Patent [19]

Chandler

[11] 4,211,463

[45] Jul. 8, 1980

[54] METAL STRAIN RELIEF CLAMP

[75] Inventor: Curtis S. Chandler, Walkertown, N.C.

[73] Assignee: AMP Incorporated, Harrisburg, Pa.

[21] Appl. No.: 11,338

[22] Filed: Feb. 12, 1979

[51] Int. Cl.[2] ..... H01R 13/58

[52] U.S. Cl. ..... 339/103 M; 339/107; 339/223 R

[58] Field of Search ..... 339/103 M, 103 B, 103 R, 339/107, 223 R

[56] References Cited

U.S. PATENT DOCUMENTS 4,127,315 11/1978 McKee ..... 339/103 B

*Primary Examiner*—Roy Lake

*Assistant Examiner*—DeWalden W. Jones

*Attorney, Agent, or Firm*—Gerald K. Kita

[57] ABSTRACT

The disclosure relates to a one-piece metal clamp which is secured to a plastic connector housing having multiple electrical terminals for connection to respective wires contained in a multiple wire cable. The clamp is adapted to grasp the cable and anchor the same to the connector. The clamp is readily closed and secured on the cable without a need for a clasp. As a consequence, the clamp may be readily opened by prying with a suitable tool without incurring damage to either the clamp or the cable. The clamp is designed for preventing excessive closure on the cable and for preventing piercing or other damage to the cable.

2 Claims, 12 Drawing Figures

2
4
6
8
10
12
14
16
18
22
24
28
30
32
34
36
38
40

METAL STRAIN RELIEF CLAMP

FIELD OF THE INVENTION

The invention relates to a clamp for anchoring a multiconductor electrical cable to a plastic connector housing having a plurality of terminals to which the cable wires are electrically connected.

BACKGROUND OF THE INVENTION

U.S. Pat No. 3,760,335 and U.S. Pat. No. 4,035,051 each discloses an electrical connector for terminating the wires of a multiple wire cable. In each connector a strap is required to anchor the cable to a cable support provided on a corresponding connector housing. In addition a shim or pressure plate is located together with the cable under the tensioned strap. The strap retains the pressure plate or shim and grips the cable to anchor the same to the connector.

U.S. Pat. No. 4,130,330 discloses a plastic cover which is slideably assembled onto a plastic connector. The cover is provided with an integral cable support having parallel arms which receive therebetween a multiconductor cable. The arms are provided on their inwardly facing sides with multiple ratchet teeth. A cable clamping plug is inserted between the arms and is provided with rows of teeth which lock with those of the arms so that clamping pressure is applied by the plug upon the cable.

In another type of clamp a strip of metal is formed into a generally U-shaped channel. The arms defining opposite sides of the channel are closed toward each other to clampingly engage therebetween a multiconductor cable. The free ends of the arms indent opposite sides of the cable; the indented cable tends to reform to an hourglass cross section with portions thereof being forced to project outwardly of the confines of the clamp. No means are provided on the clamp for limiting the amount of closure. Accordingly, damage to the cable might occur.

SUMMARY OF THE INVENTION

According to the present invention, a one-piece metal clamp includes a base portion for connection with a plastic connector housing. A pair of arm portions extend from the base portion, with each arm portion being doubled back upon itself. The doubled back portions face each other and define therebetween a cable receiving space of hourglass section. The arm portions are closed toward each other in clamping relationship on either side of a multiple wire cable. The cable section is deformed into an hourglass configuration with the multiple wires thereof being relocated and redistributed to conform within the hourglass shaped space. The loop portions are formed by doubling back the arm portions. The loop portions converge toward each other to close off the hourglass shaped space, so that the cable is confined in the space and the looped portions engage each other to prevent excessive closure. The arm portions tend to gather the wires of the cable and urge the same to one end of the hourglass shaped, cable receiving space.

Accordingly, an object of the present invention is to provide a one-piece metal strain relief clamp having a base portion for secure connection with a plastic connector housing, and a pair of arm portions extending from the base portions and being doubled back upon themselves to define therebetween a cable receiving space of hourglass shape having one end closed by said base portion and an opposite end restricted by convergence of the arm portions toward each other in a clamped relationship on an electrical multiple wire cable.

Another object is to provide a one-piece metal strain relief clamp for having a base portion for secure connection with a plastic connector housing, and a pair of arm portions extend from the base portion which are closed in clamped relationship upon a multiple wire electrical cable thereby to gather the wires of the cable into an hourglass shaped cable receiving space, forcing a majority of the wires toward one end of the cable receiving space which is closed by the base portion.

Other objects and advantages of the present invention will become apparent from the following detailed description taken in conjunction with the drawings.

DRAWINGS

FIG. 1 of the drawings is an enlarged perspective of a connector housing and cover assembly together with a metal one-piece clamp according to the present invention, with the component parts being illustrated in partially assembled configuration.

FIG. 3 is a view similar to FIG. 2 illustrating the metal clamp secured to a multiple wire electrical cable, with a plurality of the wires being secured to electrical terminals of the plastic connector.

DETAILED DESCRIPTION

Figures 1, 2, 7:
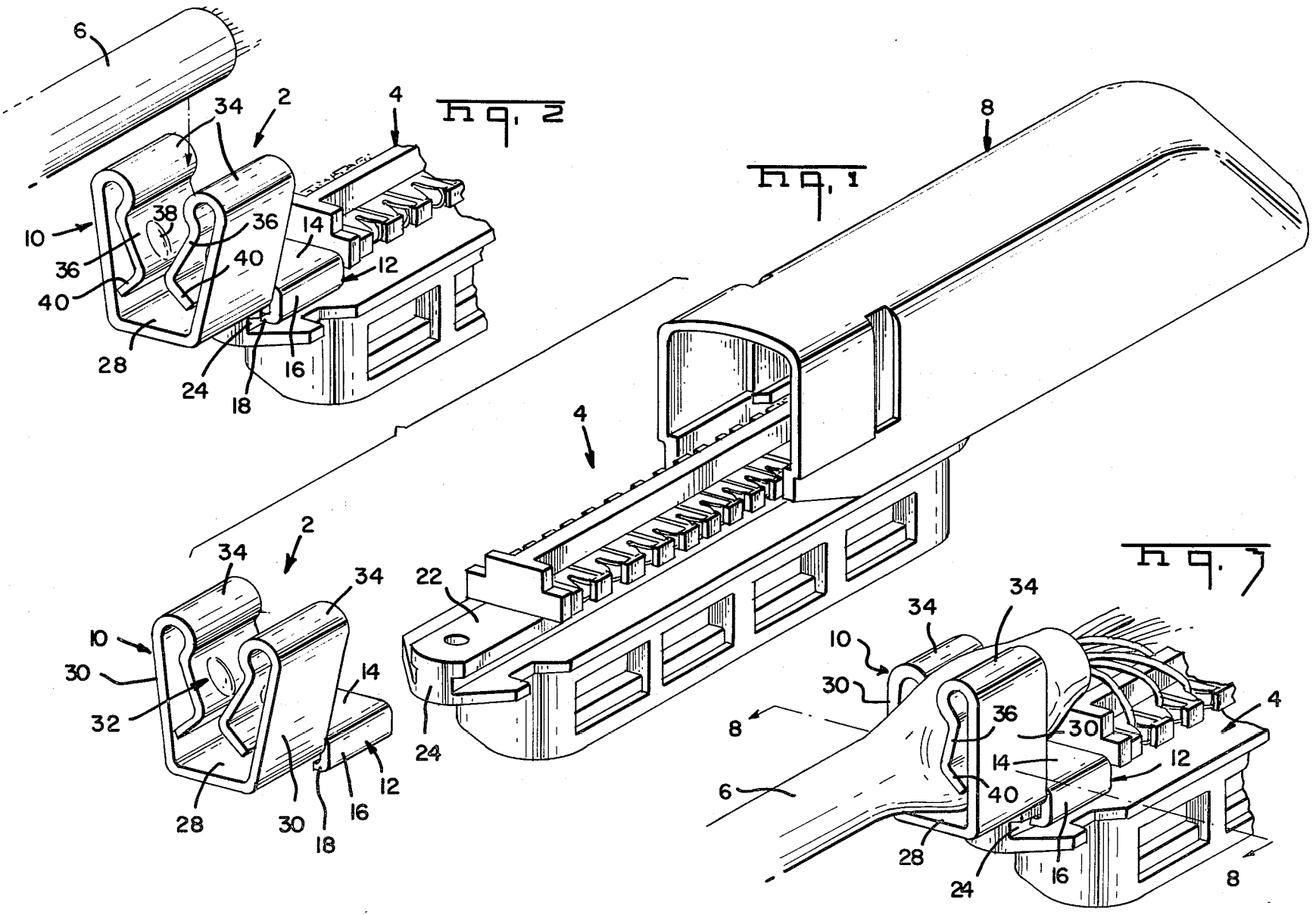
FIG. 2 is an enlarged fragmentary perspective illustrating the metal clamp assembled onto the connector.
FIG. 7 is a top plan view of the clamp as illustrated in FIG. 5.
Figure 4:
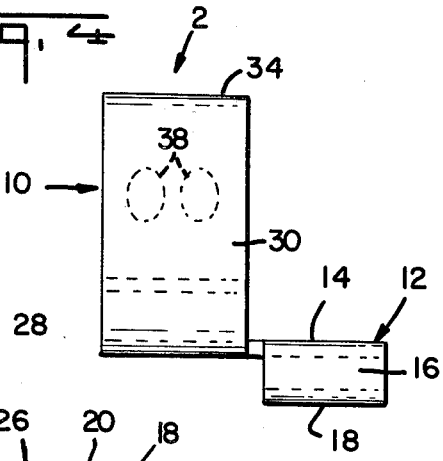
FIG. 4 is an enlarged side elevation of the clamp shown in the previous Figures.

In the first Figure, a preferred embodiment of a one piece metal clamp 2 is shown together with a plastic electrical connector 4 to which the clamp is permanetly attached for securing a cable 6 of the type having a pliable jacket encircling a plurality of individual wires. A slidable cover 8 is provided to enclose and protect the electrical connections of the multiple wire cable 6 to the connector 4 and the metal clamp connection to the cable.

The metal clamp 2 has a cable receiving portion 10 and forwardly extending mounting portion 12 by which it is secured to the electrical connector 4. Mounting portion 12 is channel shaped and includes an upper flat plate surface 14, and a pair of depending vertical sidewalls 16 which are bent inward toward each other at their free edges 18 to define an open bottom portion 18.

Figure 6:
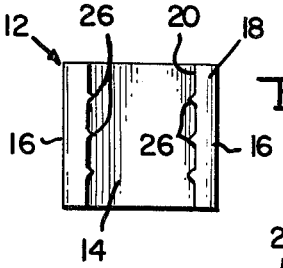
FIG. 6 is a bottom plan view of a base portion only of the clamp as illustrated in FIG. 5.
Figure 7:
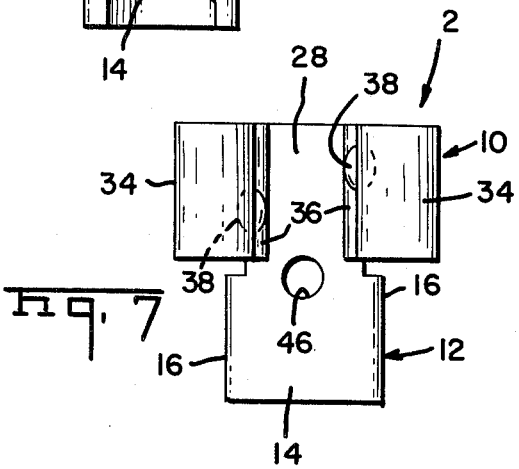

An opening 20, defined by the sidewalls 16, is complementary in shape with a T-shaped rib 24 integral with the connector. The clamp slides along the rib with the plate 14 slidable along and resting on a top portion 22 of "T" shaped rib 24, and with sidewalls 16 wrapping partially over the projecting edge portions of the "T" shaped rib. The sidewalls 16 are then pressed toward each other and compressibly onto the narrow neck portion of rib 24. To provide adequate gripping, the edges 18 are provided with a plurality of pointed teeth 26 (FIG. 6) which bite into the narrow neck portion of rib 24 to secure the metal clamp 2 to the connector 4.

The flat upper plate 14 of metal clamp 2 extends outwardly therefrom to define a base portion 28 of the cable receiving portion 10. A pair of diverging sidewalls or arms 30 extend upwardly from base 28 and are doubled back upon themselves toward the center of the clamp to define a cable receiving area 32. At the point of doubling back upon themselves, sidewalls 30 form a pair of loop sections 34 which define the uppermost portions of the clamp 2 and which serve as the means of protecting the cable from being damaged during crimping by limiting the travel of the sidewalls toward each other. When sufficient force has been applied to grip on the outer jacket and compressibly retain the cable 6, loop portions 34 abut each other to prevent further closure of the sidewalls.

Figure 5:
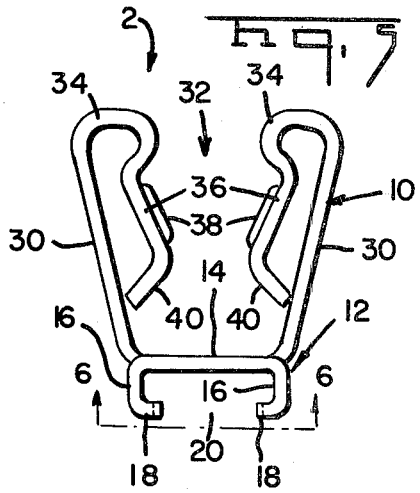
FIG. 5 is an enlarged end elevation of the clamp.
Figure 8:
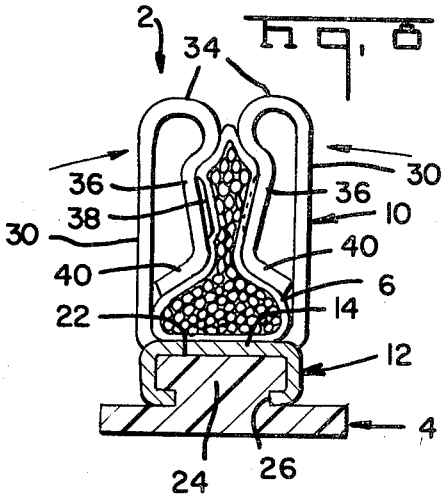
FIG. 8 is a section of the clamp and cable as taken along the line of 8—8 of FIG. 3.
Figure 9:
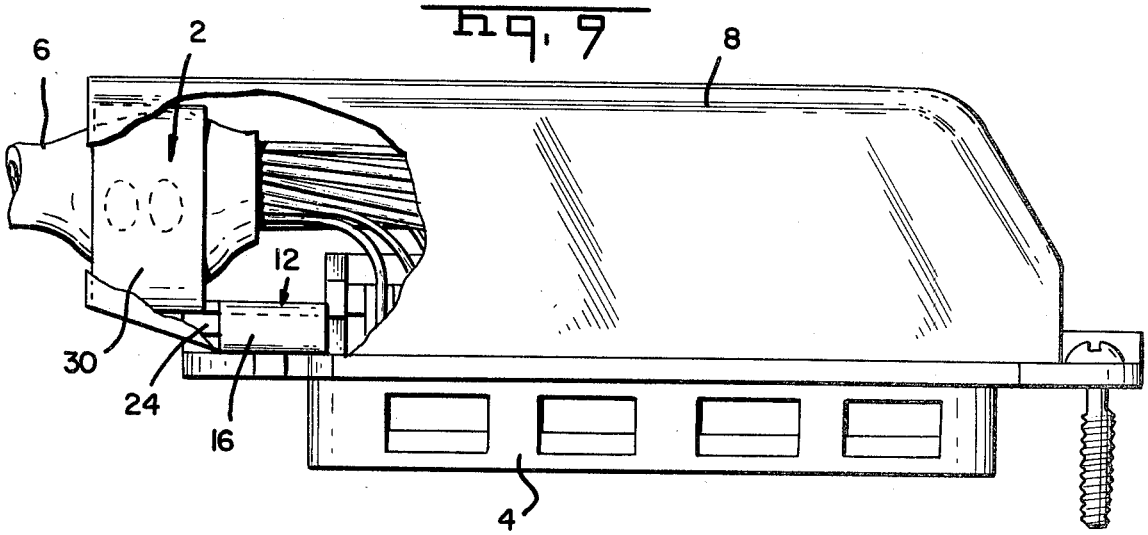
FIG. 9 is an enlarged side elevation of the component parts shown in FIG. 1 with portions partially broken away to illustrate the details thereof.
Figure 10:
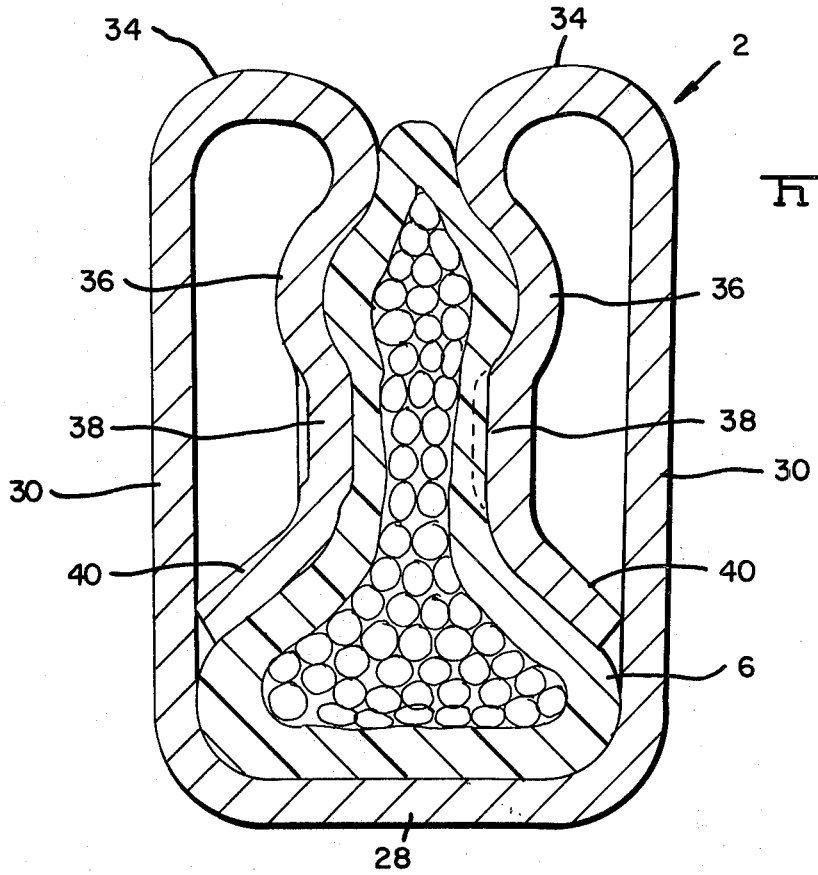
FIG. 10 is an enlarged section of the assembly of a clamp and a multiple wire electrical cable.
Figure 11:
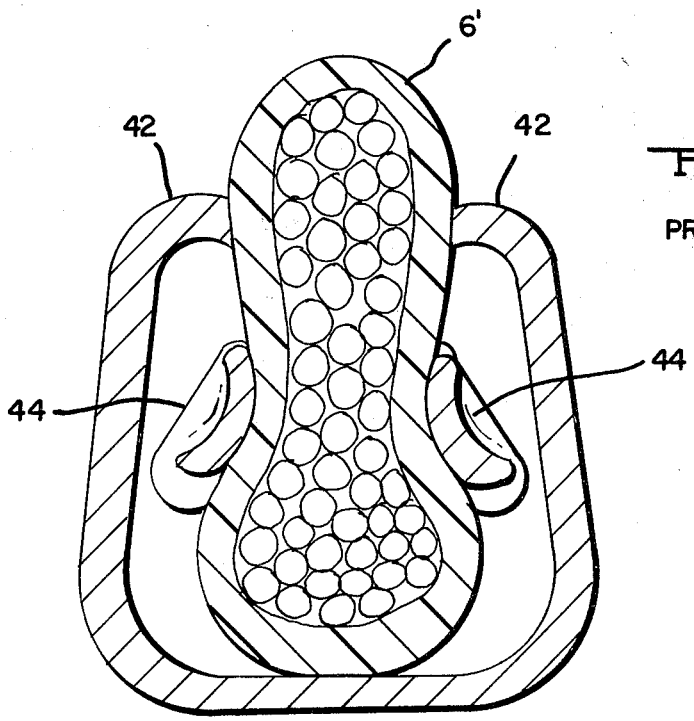
Fig. 11 PRIOR ART
FIG. 11 is an enlarged section of an assembly illustrating a cable clamp of the prior art and a similar electrical cable.
Figure 12:
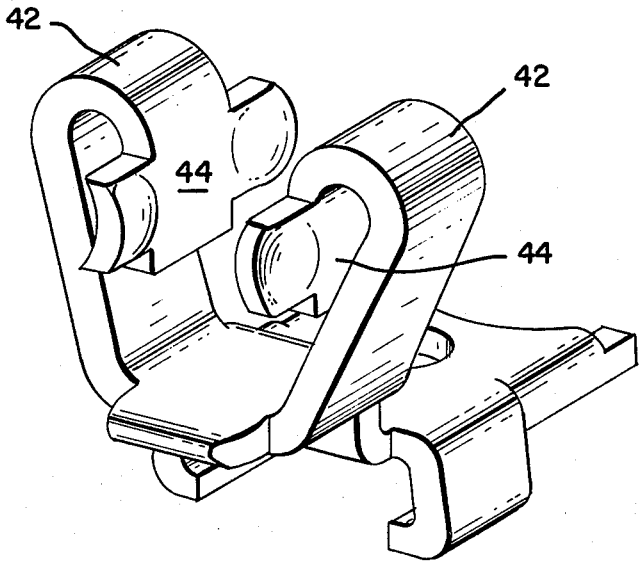
Fig. 12 PRIOR ART
FIG. 12 is an enlarged perspective of the prior art clamp.

Immediately under the portions 34, sidewalls 30 diverge, converge, and then diverge to form an hour-glass shaped opening to receive cable 6. The converging portions 36 (FIG. 5) of the sidewalls are provided with elliptically shaped bosses 38 in offset relationship with each other. These bosses provide extra gripping as they indent the sides of the cable jacket to prevent axial pull out of the cable. The lower diverging portions 40 of the sidewalls terminate initially spaced apart from the outside portions of sidewalls 30. Portions 34, wall portions 36 and 40, and base portion 28 thereby cooperate to form the hour-glass shaped cable receiving area 32. Cable receiving area 32 is of sufficient size to receive and envelop the entire cable as seen in FIGS. 8, 9, and 10, which is an advantage over the prior art shown in FIGS. 11 and 12. The prior art has curled over sidewalls 42 with downwardly depending ears 44 which grasp the cable in a manner such that excessive crimping and damage to the cable is possible. Being of a lower height than the present invention, the prior art clamp tends to clamp opposite sides of the cable, with portions of the cable projecting out of the confines of the clamp as shown at 6' in FIG. 11. The two free ends are capable of excessive deflection toward each other, consequently, excessively indenting the cable.

The height and shape of the cable receiving area 32 of the present invention tends to force the cable 6 downwardly to fill the lower portion of the cable receiving area and to close off the upper portions (FIGS. 8 and 10) of the area, with only the cable jacket between the loop portions 34 which cannot be compressed together with sufficient pressure to damage the jacket. It is to be understood that the cable jacket itself should be entirely contained in the cable receiving area. Occasionally, when the cable jacket loosely surrounds the cable wires, the jacket only may emerge between the loops 34. The cable thereby is enveloped by the clamp which prevents upward pullout of the cable laterally of its axis. The bosses 38 prevent axial pullout.

The hour-glass shape is larger in a section near the base. The wires of the cable are gathered in the cable receiving area with a majority of the wires being forced into the larger section, toward one end of the cable receiving space which is closed by the plate 14.

If any relaxation of the prior art crimp were to take place, the grip on the cable would be weakened due to the lack of built in spring characteristics of the clamp. The present invention, due to cooperation of wall portions 36 and 40, has a built in toggle type spring action which tends to maintain a firm grip on the cable even under relaxation of wall portions 30. Upon exertion of clamping force on a cable, portions 36 and 40 will tend to straighten with free end portion 40 tending to move, first toward the outside portion of sidewall 30 until impinging the same, and then relatively downwardly along the outside portion of sidewall 30, thereby causing a spring loaded and straightened toggle effect in the interconnected wall portions 36 and 40. If any relaxation or spreading apart of the outside wall portions occurs, the toggle spring loading in each inside arm portion will urge them toward the other to maintain a firm grip on the cable.

A connector of the type shown in FIGS. 1, 2, and 3 to which the present metal clamp is attached is usually held in mating position with its cooperating counterpart connector by a pair of jack screws which extend through the end sections of one connector and are threadably engaged into the end sections of the other connector. A clearance hole 46 (FIG. 7) is provided in surface 14 of the mounting portion of the disclosed metal clamp through which the jack screw is free to pass for connector mating.

At times it is desireable to re-enter a connector for repairs or changes. This is easily accomplished with the disclosed clamp, since the cable mount is fixed to the connector rather than to the connector cover. The cover is slideably mounted along the T-shaped rib and can be removed for access to the wire termination without affecting the strain relief clamp. In a previous connector, the strain relief was part of the cover and had to be disassembled before the cover could be removed.

If it is necessary to remove the cable from the clamp, the arms can easily be pried apart to release the cable, and the clamp will in no way be damaged. The cable can again be effectively held by the same clamp simply by recrimping the arms over the cable. This can be done with a simple pair of pliers since the portions 34 will not permit the clamp to be overcrimped.

Although a preferred embodiment of the present invention is disclosed and described in detail, other modifications and embodiments thereof which would become apparent to one having ordinary skill in the art are intended to be covered by the spirit and scope of the claims.

What is claimed is:

1. A one-piece metal strain relief clamp, comprising:
   a base portion for secure connection with a plastic connector housing having terminals for electrical connection to the wires of a multiple wire electrical cable, and
   a pair of arm portions each extending from said base portion and being doubled back upon itself by an enlarged loop portion so that an end portion of said arm portion is opposite the other end portion to define therebetween a cable receiving space of hour-glass section having one end closed by said base portion and an opposite open end closed off by convergence of said loop portions upon deflection of said arm portions toward each other, said end portions being between the remainder of said arm portions separating said cable receiving space from said remainder of said arm portions, and said loop portions being engageable with each other to prevent excessive closure against said cable.

2. The structure as recited in claim 1, wherein, said base portion is in the form of a channel open along a side opposite from said closed end of said cable receiving space, with gripping means provided in said channel for secure connection with a portion of a plastic connector housing onto which said channel is compressed.

* * * * *